United States Patent [19]

Hansen et al.

[11] Patent Number: 4,768,948

[45] Date of Patent: Sep. 6, 1988

[54] ANNULAR NOZZLE BURNER AND METHOD OF OPERATION

[75] Inventors: Eric Hansen, Shawnee, Kans.; James R. Tucker, Richmond, Va.

[73] Assignee: J. R. Tucker & Associates, Richmond, Va.

[21] Appl. No.: 143,085

[22] Filed: Jan. 12, 1988

Related U.S. Application Data

[62] Division of Ser. No. 828,401, Feb. 11, 1986, Pat. No. 4,732,093.

[51] Int. Cl.[4] ..... F23C 7/00

[52] U.S. Cl. ..... 431/187; 431/284; 110/263; 110/265

[58] Field of Search ..... 431/187, 188, 284, 8; 110/263–265, 347

[56] References Cited

U.S. PATENT DOCUMENTS

| | | | |
|---|---|---|---|
| 2,360,548 | 10/1944 | Conway | 431/187 X |
| 3,894,834 | 7/1975 | Estes | 431/174 |
| 3,989,443 | 11/1976 | Campbell | 431/8 |
| 4,373,900 | 2/1983 | Ecklemann | 431/182 |
| 4,428,727 | 1/1984 | Duessner et al. | 431/182 |
| 4,480,559 | 11/1984 | Blaskowski | 110/347 |
| 4,523,530 | 6/1985 | Kaminaka et al. | 110/264 |
| 4,654,001 | 3/1987 | LaRue | 431/354 |

FOREIGN PATENT DOCUMENTS

| | | | |
|---|---|---|---|
| 56-44504 | 4/1981 | Japan | 110/265 |
| 60-171307 | 9/1985 | Japan | 431/8 |
| 2043871A | 10/1980 | United Kingdom | 431/188 |
| 388170 | 10/1973 | U.S.S.R. | 431/187 |

OTHER PUBLICATIONS

"Influence of Physical Factors in Igniting Pulverized Coal", from *Combustion*, Mar. 1955, issue, pp. 57–61.

*Primary Examiner*—Samuel Scott
*Assistant Examiner*—Allen J. Flanigan

[57] ABSTRACT

A method and apparatus for burning fuel in an annular-nozzle burner wherein a compact flame is generated by inhibiting the dispersion of fuel particles and concentrating the fuel particles in a primary combustion area having a high rate of radiant heat transfer between the fuel particles by maintaining a sufficiently high velocity of the fuel particles and causing them to undergo essentially linear flow in a direction substantially parallel to the axis of the burner.

12 Claims, 4 Drawing Sheets

ANNULAR NOZZLE BURNER AND METHOD OF OPERATION

This is a division of application Ser. No. 828,401, filed Feb. 11, 1986, now U.S. Pat. No. 4,732,093.

BACKGROUND

This invention relates to the field of annular-nozzle burners. In particular, this invention concerns a method and apparatus for the introduction of a fuel air mixture into a combustion chamber in a predetermined fuel/air ratio and at a predetermined velocity to obtain high peak temperatures from a compact flame.

In many conventional dryers and burner systems, a solid fuel is mixed with a primary-air carrier and ejected into a combustion chamber. The primary air may be a proportion of the total air required for complete combustion ranging from less than ten percent up to 100 percent. Additional air needed to complete the combustion is then added to the combustion chamber as secondary air. Typically, the secondary air is preheated and enters the combustion chamber at temperatures as high as 1500° F. where it is mixed with the primary air and fuel mixture to complete combustion of the fuel. The primary air-fuel mixture, on the other hand, must be kept below 400° F. to prevent premature combustion or coal dust explosion; and, it is normally kept at or below 180° F.

Existing burner systems such as Deussner et al. (U.S. Pat. No. 4,428,727) and Eckelmann (U.S. Pat. No. 4,373,900) employ the assumption that the maximum temperature obtainable from the combustion flame is limited by the rate of mixing of the fuel with the primary and secondary air. In this respect, existing theory requires that the secondary air be intimately mixed with the fuel/air stream for rapid and complete combustion of the fuel. Thus, current burners have concentrated on methods for inducing rapid convective type mixing of the primary air/fuel with the secondary air.

Existing burner systems also take cognizance of the abrasive wear of pulverized fuel on the burner structure. This results in a controlled fuel stream of relatively low velocity. Additionally, in kiln environments the combustion chambers are often only about 160–200 or so feet long and impingement of the flame on the side walls and far end of the kiln substantially decreases the life of the kiln refractory. Construction of kilns long enough to accommodate the longer flames than have otherwise been desired, on the other hand, has caused a significant increase in the cost of the kiln. Accordingly, lower fuelair velocities of only about 2500 to 6000 feet per minute have been used to prevent the flame from impinging on the walls of the kilns.

Recent burner developments have also focused on use of deflecting vanes to obtain a spiraling or helical motion to produce a rapid, turbulent mixing of the fuel air stream with the secondary air. Thus, turbulators have been used with and without high velocity air jets to promote such mixing.

The above-described methods have provided excellent mixing of the secondary air with the primary air/fuel stream but, the high temperatures necessary to produce acceptable products in kilns and the like have not always been achieved.

A great deal of effort has also been expended in reducing the amount of the noxious nitrogen oxides (NOx) released from coal burning facilities. The traditional approach to controlling the NOx emissions is to decrease the oxygen concentration and flame temperature by recycling combustion gases. This approach has the disadvantage, however, of increasing the energy consumed in recycling and reheating these recycled gases to the flame temperatures.

In view of the foregoing, it is an object of the instant invention to provide an improved method of burning fuel and an improved burner system to overcome the shortcomings of conventional burners described above.

It is a further object of the instant invention to provide a more efficient annular-nozzle burner that can provide higher peak flame temperatures without damaging the related burner structure or refractory walls.

An alternative object of the invention is to provide an annular-nozzle burner having acceptable NOx levels while reducing the energy-consuming steps of recycling and reheating of exhaust gases.

An advantage of the invention is that it provides a smaller, shorter flame that is essentially anchored to the nozzle so as to permit smaller combustion chambers and reduce the amount of flame impingement on refractory-surface walls. An additional advantage of the invention is an improvement in products that are heated by the burners and method of the invention.

A further advantage of the invention results from an unexpected increase in annulus life even though the invention provides high peak flame temperatures.

A still further advantage of the invention stems from the flame being better stabilized or "anchored" to the burner than those of comparable existing burners. In this respect, where pulverized particulate fuels are employed, it is customary to first use gas or oil-fired flames to heat the refractory walls at a controlled rate until sufficiently hot to maintain combustion of the particulate fuel upon changeover. The instant invention, however provides a core flame which easily stabilizes combustion of the particulate fuel on the burner and permits a more rapid change-over from the more expensive start-up fuels to the desired particulate fuels. In this respect, the following description of the invention will refer to "particles" of fuel. Such use of "particles", however, is not limited to pulverized, particulate fuels, but includes molecules of gas and droplets of liquid fuels as will be clear from the examples herein relating to various fuels. Similarly, although the invention is described in terms of annular-nozzle burners having a cylindrical cross-section, such burners can also have cross-sections that are other than cylindrical.

As a result of much testing and evaluation by the instant inventors, it has been determined that the customary maximizing of convective mixing of secondary air with the primary air-fuel stream has been counterproductive; and, contrary to popular thought, has not provided the most desirable temperatures and flame configurations. Indeed, it is customary for the primary air/fuel mixture to be intensely mixed with secondary air specifically in order to disperse the fuel particles. The instant inventors have found, however, that it is undesirable to increase the average distance between particles.

SUMMARY OF THE INVENTION

The method of the invention employs an annular-nozzle burner wherein a compact flame is generated by inhibiting dispersion of the fuel particles and concentrating the fuel particles in a primary combustion area of the flame so that a high rate of radiant heat transfer is maintained between the fuel particles. This, of course, is the opposite of the theories applied to conventional annular-nozzle burners, but, as will be noted below, has resulted in vastly-improved operation. In this respect, it has previously been determined that heat in a high temperature flame is transferred primarily by radiation; and, the rise in temperature as the fuel leaves the burner is primarily a function of radiant heat transfer from hot fuel particles to cold fuel particles. Accordingly, a given particle's temperature is also a function of its distance from adjacent burning particles; and, the instant invention employes these principles to obtain improved results.

In accordance with another aspect of the invention it has been determined that the NOx in the exhaust gases can be substantially reduced by maintaining the primary combustion area in a reducing atmosphere; and, this is accomplished by preventing excess oxygen from reaching the burning particles.

It has previously been determined that the rate of burning of a solid fuel particle is a function of the oxygen that is available at its surface. The oxygen transfer from the fuel/air stream to a given fuel particle, however, is dependent upon the oxygen's gaseous diffusion through a boundary layer surrounding the particle to its burning surface.

Based on the above, it has been determined that a method of improving the rate of oxygen transfer to a particle's burning surface is to increase the relative velocity differential between given particles and the secondary air; and, it is believed that this causes a decrease in the thickness of the boundary layer. In one embodiment of the invention, for example, pulverized solid fuel is carried at a high speed through an annular nozzle by primary air into the combustion chamber where it passes through relatively stationary secondary air and it has been found that this interaction vastly improves combustion.

In accordance with another aspect of the invention the annular nozzle includes an inner core area and an outer fuel-entry annulus; and, it has been found that by using relatively small amounts of primary air to force the particulate fuel through the annulus at relatively high velocities of at least about 7000 fpm and above, the resulting fuel/air flow is essentially linear and, moreover, creates a low-velocity vortex effect in the core area. This low-pressure area provides a core flame along the flame's axis. Further, this low pressure, low velocity region at the core serves to anchor the flame on the burner tip in such a manner that the flame is not blown out even at fuel/air velocities of over 20,000 fpm. Moreover, this effect can be further increased by maintaining a high ratio between the outer dimension of the fuel-entry annulus and its cross-sectional area to thereby increase the volume of the core-flame area.

In the above regard, the use of "linear" is not to be confused with "laminar flow". "Linear" is used here in the sense that a given particle moves essentially only in an axial direction with little dispersion—much like "plug flow" in a pipe.

The characteristics of the annular-nozzle burner constructed and operated in accordance with the above principles result in a very compact, intense flame, which allows use of a much smaller, more efficient furnace. Moreover, in certain embodiments, a better product is produced in greater quantities than with much larger furnaces using conventional annular-burner systems. Still further, the method and apparatus of the invention have the additional advantage of permitting the controlled buildup of a protective coating on the furnace walls which, in some instances, can considerably postpone the need for expensive repairs.

BRIEF DESCRIPTION OF THE DRAWINGS

The foregoing and other objects, features and advantages of the invention will be apparent from the following more particular description of preferred embodiments of the invention as illustrated in the accompanying drawings, wherein the same reference characters refer to the same parts throughout the various views. The drawings are not necessarily drawn to scale. Instead, they are merely presented so as to illustrate principles of the invention in a clear manner.

DESCRIPTION OF THE PREFERRED EMBODIMENTS

Figure 1:
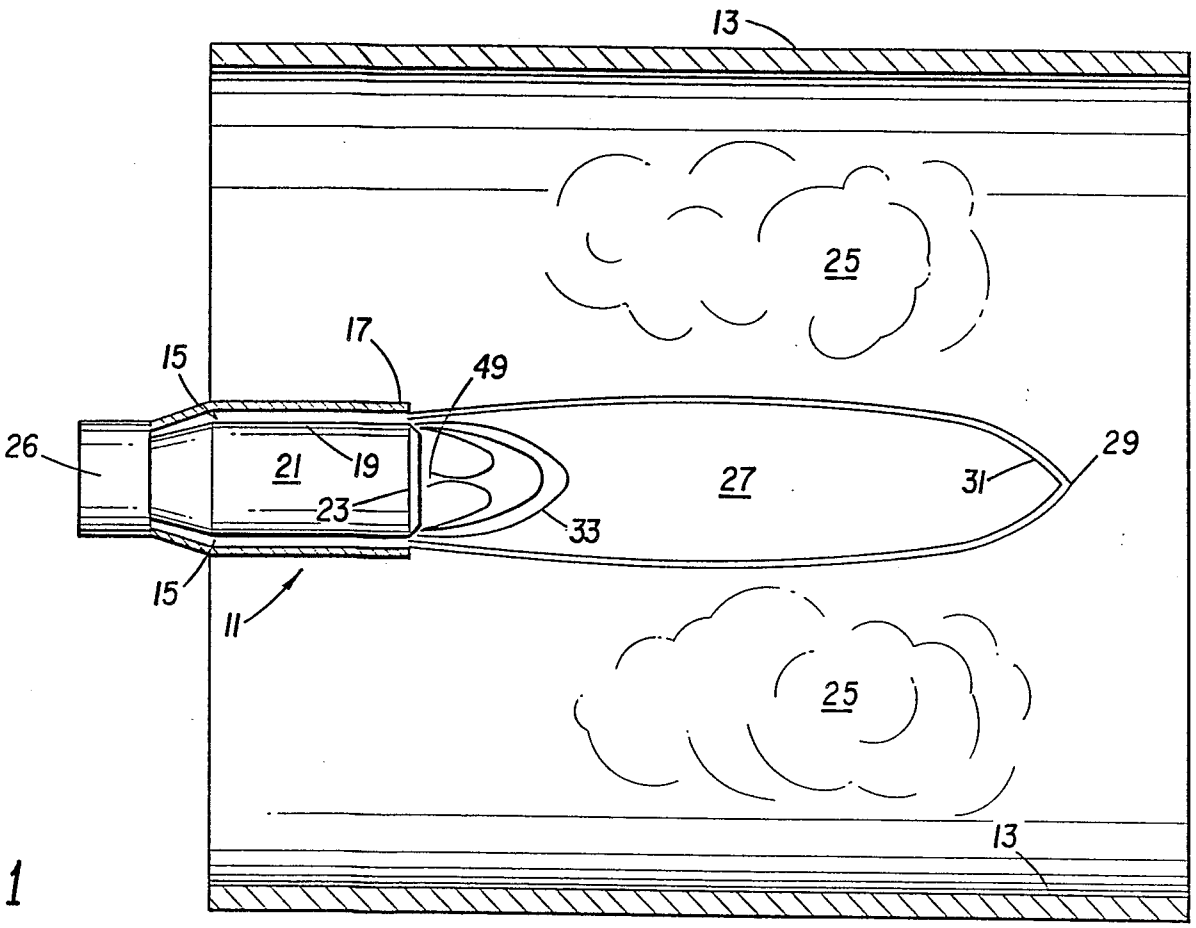
FIG. 1 is a schematic representation of an annular-nozzle burner used in the practice of the method of the invention.

FIG. 1 is a schematic representation of an annular-nozzle burner 11 installed in a furnace having refractory walls 13. A primary air-fuel annulus 15 is formed between an exterior pipe 17 and an inner pipe 19. A center core 21 of the burner 11 may be open or may be closed by a refractory plug 23. Secondary air enters the combustion chamber through conventional means and surrounds flame 27 in areas 25.

The primary air and fuel are blown by a fan means 26 through the annulus 15 into the combustion chamber where they are ignited to form an intense compact flame 27. A burnout point 29 is the distance from the nozzle at which approximately 95 percent of the fuel has burned. A peak flame-temperature-point line 31 is represented by an inner line which, in a preferred embodiment, is approximately 0.4 cm from the outer surface of the flame 27.

The annular-nozzle burner 11 also promotes combustion in a low velocity, low pressure region in an inner core 33 of the flame 27. As shown, this inner core 33 of the flame produces a vortex effect creating a fuel ignition point very close to or at the tip of the burner 11. In this respect, the refractory plug 23 can serve as an igniter when used.

Figure 2:
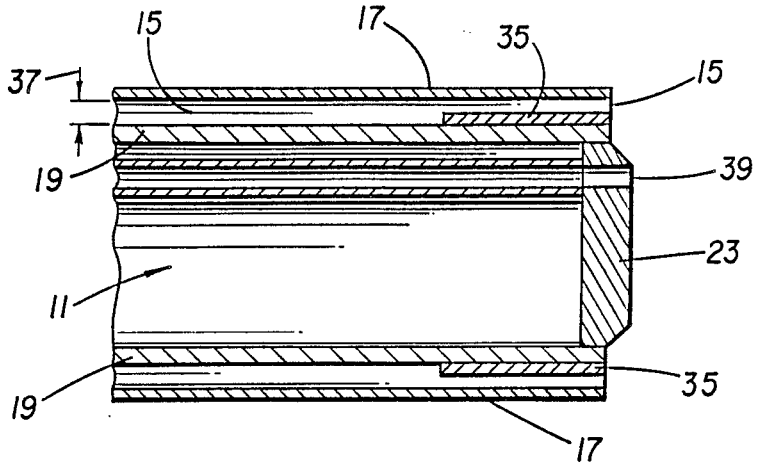
FIG. 2 is an enlargement of a portion of FIG. 1.

FIG. 2 is an enlarged illustration of the annular burner 11 and shows a machined cylindrical insert 35 which extends back from the tip about 4 to 12 times the width 37 of the annulus 15. The surface of the insert 35 is machined smooth to remove any substantial burrs or the like and assists in the production of a linear flow of the fuel-primary-air mixture from the annulus 15 of the annular-nozzle burner 11.

FIG. 2 also illustrates a pilot light port 39 from which burning gas can be initially ejected to ignite the flame 27 on startup. Alternately, an igniter can be extended from the port 39 to perform the same function.

Figure 3:
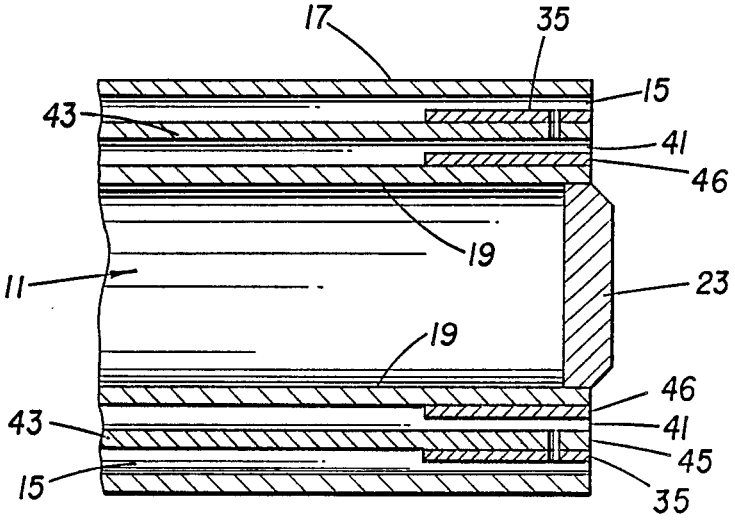
FIG. 3 is an enlargement of a portion of FIG. 1 and includes additional elements for other embodiments of the invention.

FIG. 3 shows an additionally-enlarged schematic illustration of an alternate burner 11 with an inner annulus 41 formed between the pipe 19 and the outer annulus 15. This inner annulus 41 is formed by an annular insert 43 between the pipe 19 and the annulus 15 and provides a passage for either an alternate fuel or a starting fuel such as gas or oil. In this respect, the inner annulus 41 also contains a machined insert 46 corresponding to the machined insert 35 in the primary annulus. Radial air passages 45 may also be peripherally positioned around the insert 43 as shown to lead from the inner annulus 41 to the primary air-fuel annulus 15 in FIG. 3. Although, as suggested above, it is sometimes desirable to have a controlled build-up in the refractory walls, these jets of air from passages 45 are used to selectively disturb the linear flow and selectively modify the flame from its compact, intense configuration to a long bushy flame for dislodging any excessive buildup of material on the refractory lining.

The diameter of the outer annulus 15 can be varied at a constant cross-sectional area to provide the desired high-velocity linear flow and still produce the desired compact, intense flame 27.

In operation, the primary air and the incoming fuel, such as pulverized coal or the like, are blown by the fan through the fuel annulus 15. The primary air can be quite limited in quantity and is injected at a high velocity of at least about 7,000 fpm to carry the fuel into the combustion chamber of the furnace.

Because of the essentially linear flow of the primary air and fuel particles, the fuel particles remain in close proximity. As they pass into the combustion chamber the thickness of their boundary layers is reduced as the fuel particles and primary air are moved at a higher velocity through the secondary air in the combustion chamber. This then allows for more rapid diffusion of oxygen through the boundary layer to the burning surfaces of the particles so that the particles are then ignited by the radiation heat from the already-ignited particles. The high velocity primary air and fuel mixture then complete the burning.

The vortex effect of the inner core 33 of the flame 27 maintains the fuel ignition point very close to the tip of the burner even at the highest fuel-air stream velocities. The high velocity of the fuel-air stream extends the life of the annulus by causing a cooling effect at the entry of annulus 15 into the combustion chamber.

Tests using the annular nozzle in the manner described above have been conducted with a great deal of success. Even with pulverized coal, an intense, very high tip flame was produced that was compact and was as short as only 20 feet in length. Moreover, the tests showed the method and apparatus of the invention to be substantially more efficient than the convection-mixing type burners. Still further, the concept of the annular nozzle used as described above is applicable with similar results to both liquid and gaseous fuels.

In the above regard, it is the increased particle velocity in combination with the limited amount of primary air in a linear-flow mode that is believed to cause the increase in the rate of combustion and the high peak flame temperatures which result in such a significant reduction in the fuel usage per ton of product. In addition, in some instances, the higher temperature has the distinct advantage of producing a better product. In a cement kiln embodiment, for example (as compared with products produced by conventional means) the product produced by the method of the invention had a smaller crystal size, higher strength and a desirably lower alkali content.

At the same time, the measurable NOx produced from the above described method of using an annular-nozzle burner has been substantially reduced without resorting to the energy-sapping recycling of combustion gases. Hence, the invention has wide utility and can be applied to other types of burners used in commercial and utility boilers or the like to lead to considerable fuel savings; a reduction in the amount of recycled combustion air; and, an effective control for nitrogen oxides.

EXAMPLE 1

Figure 5:
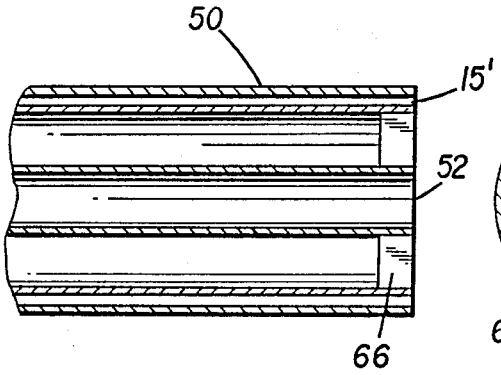
FIG. 5 is a cross-sectional view taken along the lines 5—5 of FIG. 4.
Figure 4:
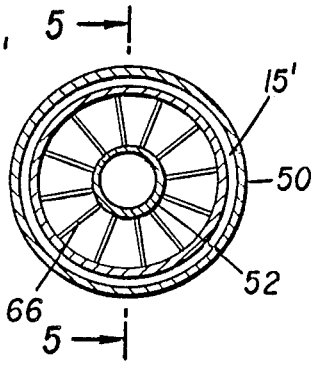
FIG. 4 is an end view of an annular nozzle employed in one of the examples of the invention.

FIGS. 4 and 5 represent a modification of a burner of the type described in U.S. Pat. No. 4,428,727. The furnace in which this example was employed was of the "indirect" firing type wherein pulverized, dried coal was collected in a cyclone and filter collector and then carried through annulus 15' by primary air at ambient temperature.

An outer pipe 50 had an inner diameter of 12 inches and the width of the annulus 15' was 0.75 inches. Pulverized coal at a rate of 5–7 tons per hour and primary air at about 3600 cfpm were passed through the annulus 15' at a maximum velocity of about 19,557 fpm. In this respect, peak flame temperatures increased as velocities through annulus 15' increased and NOx was significantly reduced by lowering excess air to a minimum. Carbon monoxide monitors were used to control inlet devices for air to reduce excess oxygen to less than 1.5 percent oxygen so that NOx in the exhaust gases was reduced to below 400 parts per million.

At maximum firing capacity primary air was approximately ten percent of the total combustion air with secondary air being the balance.

During normal operation there was no flow through an inner core 52. Indeed, any flow in the inner core had a negative effect on peak flame tempertures. Small amounts of primary air, however, were diverted by a means not shown from the coal conveying line to the inner core 52 for short periods of time (less than one hour) in order to change the flame shape by substantially increasing its cross-sectional area until undesirable buildups were removed from the refractory walls.

EXAMPLE II

The furnace of this example was of the direct feed type wherein pulverized coal was blown directly to the burner after being dried and pulverized. In direct-fired furnaces, primary air is usually a higher percentage of combustion air and, since it comes directly from the coal mill, is already at an elevated temperature. In this respect, in the embodiment of this example, the primary air from the coal mill was at a temperature of between about 150° and 180° F.; and, at maximum firing capacity, primary air was between about 33 and 40 percent of total combustion air—secondary air making up the balance.

The furnace of this particular embodiment was used in connection with a rotary cement kiln; and, immediately upon startup of the apparatus using the method of the invention, a significant improvement in flame shape was observed. Moreover, significant increases in clinker quality and thermal-energy efficiency were also noted. Still further, the kiln produced 7 percent more product per unit-time with no additional fuel input; and, a desirable low-alkali cement was obtained without the addition of calcium chlorides and without reducing kiln capacity.

Figure 7:
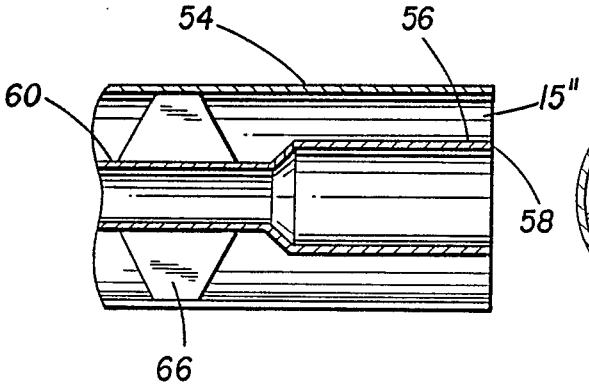
FIG. 7 is a sectional view taken along the line 7—7 of FIG. 6.
Figure 6:
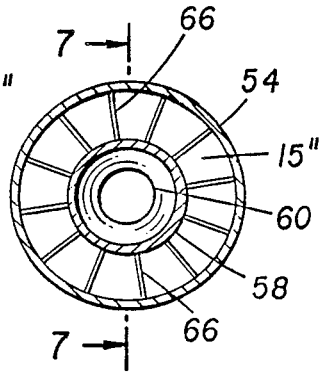
FIG. 6 is an end view of another annular nozzle employed in one of the examples of the invention.

The annular burner of FIGS. 6 and 7 was used with pulverized coal/coke at a rate of about 10 tons per hour and primary air at a rate of between about 14,000 and 18,000 cfpm at estimated maximum velocities of between about 14,560 and 18,725 feet per minute.

The inner diameter of the outer pipe 54 was 15½ inches and the diameter of inner pipe 56 was 8 inches, leaving a width of annulus 15'' of 3.75 inches. In this respect, the pipe 56 extended from the tip 58 to a reduced-area portion 60 located about 12 inches from the tip 58.

EXAMPLE III

Figure 9:
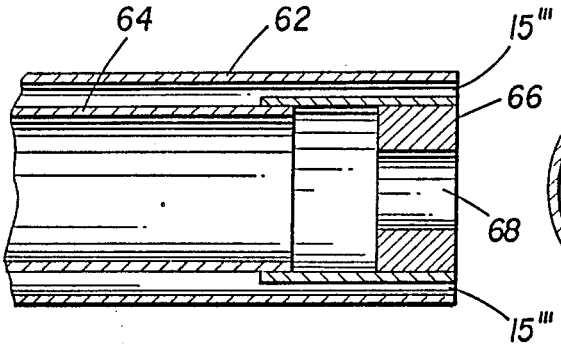
FIG. 9 is a sectional view taken along the line 9—9 of FIG. 8.
Figure 8:
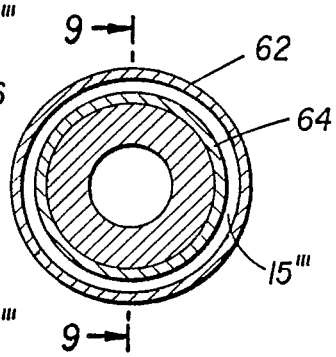
FIG. 8 is an end view of yet another annular nozzle employed in one of the examples of the invention.
Figure 11:
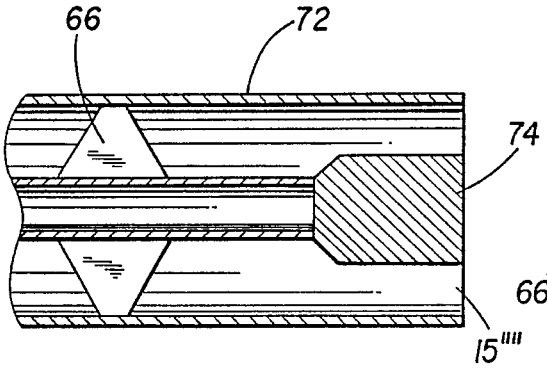
Figure 10:
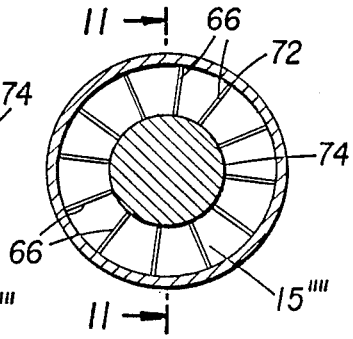
FIG. 10 is an end view of still another annular nozzle employed with still another example of the invention; and, FIG. 11 is a sectional view taken along the lines 11—11 of FIG. 10.

The FIGS. 8 and 9 embodiments were used in connection with an acetylene-fired burner. Primary air at between 0 to 10 cfpm was used with acetylene at between 5 to 10 cfpm at velocities ranging from about 7330 fpm to 29,335 fpm.

Outer pipe 62 had an inner diameter of 1 inch; an inner pipe 64 had an outer diameter of 0.9375 inch; and, the annulus 15''' had a width of 0.03125 inch. A plug 66 was affixed to the inner part of inner pipe 64 to provide an orifice 68 having a diameter of 0.34 inch. In this respect, it is noted that suitable inner pipe supports such as 66 were included in the embodiments of FIGS. 4–11.

Acetylene gas from cylinders was fed into the annulus 15''' with various amounts of compressed air. Even at lower velocities the flame was relatively short (about 10–12 inches) and approximated 1.5 inches in diameter at its maximum point. Contrary to what would be expected, as air/fuel velocity was increased, the ignition point came closer and closer to the burner tip. Initially, for example, the ignition point was 0.5 to 0.75 inches from the tip. At maximum velocity, however, the ignition point appeared to be anchored to the tip and the flame length shortened to 7–8 inches. The flame also became more luminescent as velocity was increased; and, at maximum air/fuel flows obtainable from the equipment being employed it was not possible to "blow out" the flame or cause the ignition point to leave the burner tip.

During normal operation the orifice 68 was plugged. When the plug was removed and very small amounts of air (less than 1 cubic foot per minute) were delivered through orifice 68 at very low velocities, however, the flame appeared to be slightly more intense, but somewhat longer. More than a very minimum amount of such air through orifice 68 caused dispersion and disruption of the flame and created black smoke.

In a comparative study, the annulus 15''' was blocked and an orifice corresponding to 68 was fabricated to have the same cross-sectional area as the annulus 15'''. Except as noted, other parameters were the same. In this respect, at fuel-air velocities of about 7,000 fpm, the burner had a flame about 2 feet long and 0.75 inches in diameter with an ignition point approximately 0.5–0.75 inches off the burner tip. The flame, however, was considerably more yellow and produced a significant amount of black smoke. As velocities were increased to 10,000–15,000 fpm, the flame lengthened without a significant increase in diameter and the ignition point moved further from the tip. As velocities were increased still further, the flame moved off of the tip approximately 3 inches and was then blown out. Maximum flame length attained prior to blowout was approximately 36 inches.

EXAMPLE IV

In this example, an outer pipe 72 had an inner diameter of 4 inches and an inner plug 74 had an outer diameter of 2 inches to provide a 1 inch wide annulus 15''''.

The fuel was natural gas at 25–50 cfpm; the primary air volume was between about 250 and 500 cfpm; and, estimated velocities were between about 4200 and 8400 fpm.

The above-described embodiment was used in connection with a vertical combustion chamber. The burner was tested with and without the inner core 74 of FIGS. 10 and 11. Without the inner core the ignition point for the burner flame was in excess of two feet from the tip and, even at lower velocities, the flame was unstable. At higher velocities the flame was erratic and easily blown out. With the inner core 74 installed, the ignition point was approximately 0.25 inches from the burner tip even at lower velocities and the flame was very stable. A visible blue flame was noted at the center of the burner tip. After the tests were complete, a discoloration was noted in the center of the inner-core plug 74 indicating that ignition was actually taking place at or near the tip.

Based upon data collected thus far it appears that the maximum ratio of the outer diameter to the inner diameter of the annulus 15 is about 2.0; and, the numeric ratio of the outer diameter to the area of the annulus should be more than about 0.1. For most embodiments the minimum efficient operating velocity at the discharge from the annulus 15 into the combustion chamber is about 7000 fpm; the minimum length of the smooth annular surface represented by insert 35 in FIG. 3 is about equal to the width of the annulus 15, but a preferred length of the smooth annular surface corresponding to insert 35 is between about four and 12 times the width of the annulus 15.

While the invention has been particularly shown and described with reference to preferred embodiments thereof, it will be understood by those skilled in the art that various changes in form and detail may be made therein without departing from the spirit and scope of the invention.

The embodiments of the invention in which an exclusive property or privilege is claimed are defined as follows:

1. A burner for ejecting fuel into a combustion chamber, said burner comprising:

an inner-core area;

an outer fuel-entry annulus substantially surrounding said inner-core area;

means for ejecting said fuel into said combustion chamber essentially only through said fuel-entry annulus;

means in said inner-core area for limiting the amount of combustion air passing therethrough; and, linear-flow means for causing the fuel flowing from said annulus to be in an essentially linear-flow state.

2. Apparatus according to claim 1 including means for selectively introducing additional air into said fuel-entry annulus in a non-axial direction to selectively modify the shape of the resulting flame.

3. Apparatus according to claim 1 wherein said linear flow means includes a lining means lining said fuel-entry annulus.

4. Apparatus according to claim 3 wherein the extent of said lining means along the axis of said annular-nozzle is at least equal to the width of said annulus.

5. Apparatus according to claim 3 wherein said extent of said lining means is between about four and twelve times the width of said annulus.

6. Apparatus according to claim 3 including means for selectively and temporarily reducing the linearity of said linear flow to selectively and temporarily increase the outer dimension of the resulting flame extending from said burner.

7. Apparatus according to claim 1 wherein said fuel-entry annulus has an inner and an outer dimension and wherein the ratio of said outer dimension to said inner dimension is no more than about 2.0 to 1.0.

8. Apparatus according to claim 7 wherein the ratio of said outer dimension to the area of said annulus is at least about 0.1 cm. to 1.0 $cm^2$.

9. Apparatus according to claim 1 including means for discharging fuel from said fuel-entry annulus at at least about 7000 feet per minute.

10. Apparatus according to claim 1 wherein said fuel-entry annulus has an inner and an outer dimension and wherein the ratio of said outer dimension to the area of said annulus is at least about 0.1 cm. to 1.0 $cm^2$.

11. Apparatus according to claim 1 wherein said annular-nozzle burner produces a flame having a primary combustion area and wherein said burner includes means for maintaining an essentially reducing atmosphere in said primary combustion area.

12. Apparatus according to claim 11 including means to produce a core flame area in the center of said flame.

* * * * *